US009371724B2

(12) United States Patent
Grave et al.

(10) Patent No.: US 9,371,724 B2
(45) Date of Patent: Jun. 21, 2016

(54) MULTIPHASE SEPARATION SYSTEM

(71) Applicant: EXXON-MOBIL UPSTREAM RESEARCH COMPANY, Houston, TX (US)

(72) Inventors: Edward J. Grave, Spring, TX (US); Adam S. Bymaster, Burleson, TX (US); Tracy A. Fowler, Magnolia, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/406,121

(22) PCT Filed: May 1, 2013

(86) PCT No.: PCT/US2013/039080

§ 371 (c)(1),
(2) Date: Dec. 5, 2014

(87) PCT Pub. No.: WO2014/058480

PCT Pub. Date: Apr. 17, 2014

(65) Prior Publication Data

US 2015/0300146 A1 Oct. 22, 2015

Related U.S. Application Data

(60) Provisional application No. 61/711,132, filed on Oct. 8, 2012.

(51) Int. Cl.
*E21B 43/36* (2006.01)

(52) U.S. Cl.
CPC ..... *E21B 43/36* (2013.01)

(58) Field of Classification Search
CPC ..... E21B 33/035; E21B 43/36
USPC ..... 166/368, 357
See application file for complete search history.

(56) References Cited

U.S. PATENT DOCUMENTS 1,559,115 A 10/1925 Marker et al. ..... E21B 43/34
2,423,793 A * 7/1947 Olivo ..... E21B 43/34 210/535

(Continued)

FOREIGN PATENT DOCUMENTS

CN 101402004 4/2009 ..... B01D 19/00
RU 2451251 5/2012 ..... F25J 3/00

OTHER PUBLICATIONS

Chuang, K. T. et al. (2000) "Tray Columns: Design," *Academic Press*, pp. 1135-1140 (retrieved from the internet on Dec. 4, 2014: http://razifar.com/cariboost_files/Tray_20Columns_20Design.pdf.

(Continued)

*Primary Examiner* — Matthew R Buck
(74) *Attorney, Agent, or Firm* — ExxonMobil Upstream Research Company

(57) ABSTRACT

A system and method for separation of liquids and gases within a multiphase fluid are provided herein. The method includes flowing a multiphase fluid into a number of divisions within a multiphase separation system, wherein the divisions are configured to lower a velocity of the multiphase fluid. The method also includes separating the multiphase fluid among a number of lower pipes and a number of upper pipes, wherein each lower pipe includes an expansion zone configured to lower a pressure within the lower pipe to allow entrained liquids to drain from a corresponding upper pipe via a downcomer.

32 Claims, 8 Drawing Sheets

(56) References Cited

U.S. PATENT DOCUMENTS

| | | | | |
|---|---|---|---|---|
| 3,768,726 | A | 10/1973 | Hale et al. | 233/16 |
| 4,187,088 | A | 2/1980 | Hodgson | 55/169 |
| 4,661,127 | A * | 4/1987 | Huntley | E21B 43/36 166/267 |
| 4,705,114 | A * | 11/1987 | Schroeder | E21B 43/36 166/267 |
| 4,708,793 | A * | 11/1987 | Cathriner | B01D 19/0042 166/267 |
| 5,149,344 | A * | 9/1992 | Macy | B01D 17/00 166/267 |
| 6,197,095 | B1 | 3/2001 | Ditria et al. | 95/248 |
| 7,051,540 | B2 | 5/2006 | TeGrotenhuis et al. | 62/93 |
| 7,363,982 | B2 | 4/2008 | Hopper | 166/357 |
| 7,490,671 | B2 | 2/2009 | Gramme et al. | 166/357 |
| 7,516,794 | B2 | 4/2009 | Gramme et al. | 166/357 |
| 7,540,902 | B2 * | 6/2009 | Esparza | B01D 19/0042 210/537 |
| 7,611,635 | B2 * | 11/2009 | Chieng | B01D 17/00 210/537 |
| 7,901,492 | B2 * | 3/2011 | Gramme | B01D 19/0042 210/537 |
| 8,220,551 | B2 * | 7/2012 | Fenton | E21B 43/36 166/267 |
| 8,273,151 | B2 * | 9/2012 | Miotto | B01D 19/0036 166/357 |
| 8,282,711 | B2 * | 10/2012 | Grenstad | E21B 43/36 166/357 |
| 8,454,843 | B2 * | 6/2013 | Brown | B01D 21/245 166/267 |
| 8,657,897 | B2 | 2/2014 | Kayat et al. | 55/337 |
| 8,657,940 | B2 * | 2/2014 | Aarebrot | B01D 17/0214 55/447 |
| 8,778,159 | B2 | 7/2014 | Liverud et al. | 204/563 |
| 2005/0006086 | A1 | 1/2005 | Gramme | 166/105.5 |
| 2010/0032164 | A1 | 2/2010 | Bakke | 166/366 |
| 2010/0326922 | A1 | 12/2010 | Varanasi et al. | 210/708 |
| 2012/0160103 | A1 | 6/2012 | Suppiah et al. | 95/249 |

OTHER PUBLICATIONS

Hannisdal, A. et al. (2012) "Compact Separation Technologies and Their Applicability for Subsea Field Development in Deep Water," *Offshore Technology Conference*, OTC23223, Houston, Texas Apr. 30-May 3, 2012, pp. 1-12.

* cited by examiner

100

200

200

400

500

500

700

700

MULTIPHASE SEPARATION SYSTEM

CROSS-REFERENCE TO RELATED APPLICATION

This application is the National Stage of International Application No. PCT/US2013/039080, filed May 1, 2013 which claims the priority benefit of U.S. Provisional Patent Application 61/711,132 filed Oct. 8, 2012 entitled MULTIPHASE SEPARATION SYSTEM, and relates to U.S. Provisional Patent Application 61/676,573 filed on Jul. 27, 2012 entitled MULTIPHASE SEPARATION SYSTEM, the entirety of which is incorporated by reference herein.

FIELD OF THE INVENTION

The present techniques provide for the separation of gases and liquids within production fluids. More specifically, the techniques provide for the separation of production fluids into gases and liquids using a subsea multiphase separation system.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Any of a number of subsea separation techniques may be used to enhance the amount of oil and gas recovered from subsea wells. However, subsea separation at water depths greater 1500 meters becomes especially challenging due to the environmental conditions. As water depth increases, the external pressure on a vessel created by the hydrostatic head increases the required wall thickness for vessels used for subsea processing. At water depths greater than 1500 meters, this wall thickness has increased to such an extent that typical gravity separation is not practical. In addition, vessels with such a large wall thickness can be a challenge to fabricate, and the added material and weight can impact project economics, as well as the availability of the vessel for maintenance. As a result, large diameter separators often cannot be used at such depths.

SUMMARY

An exemplary embodiment provides a multiphase separation system including an inlet line configured to allow a multiphase fluid to flow into the multiphase separation system. The inlet line includes a number of divisions configured to lower a velocity of the multiphase fluid and feed the multiphase fluid into a distribution header. The distribution header is configured to split the multiphase fluid among a number of lower pipes, wherein each lower pipe includes an expansion zone. The system also includes a number of upper pipes branching from the lower pipes. The expansion zones are configured to lower a pressure within the lower pipes to allow entrained liquids to drain from the upper pipes via a corresponding downcomer.

Another exemplary embodiment provides a method for separation of liquids and gases within a multiphase fluid. The method includes flowing a multiphase fluid into a number of divisions within a multiphase separation system, wherein the divisions are configured to lower a velocity of the multiphase fluid. The method also includes separating the multiphase fluid among a number of lower pipes and a number of upper pipes, wherein each lower pipe includes an expansion zone configured to lower a pressure within the lower pipe to allow entrained liquids to drain from a corresponding upper pipe via a downcomer.

BRIEF DESCRIPTION OF THE DRAWINGS

The advantages of the present techniques are better understood by referring to the following detailed description and the attached drawings, in which.

DETAILED DESCRIPTION

Figure 1:
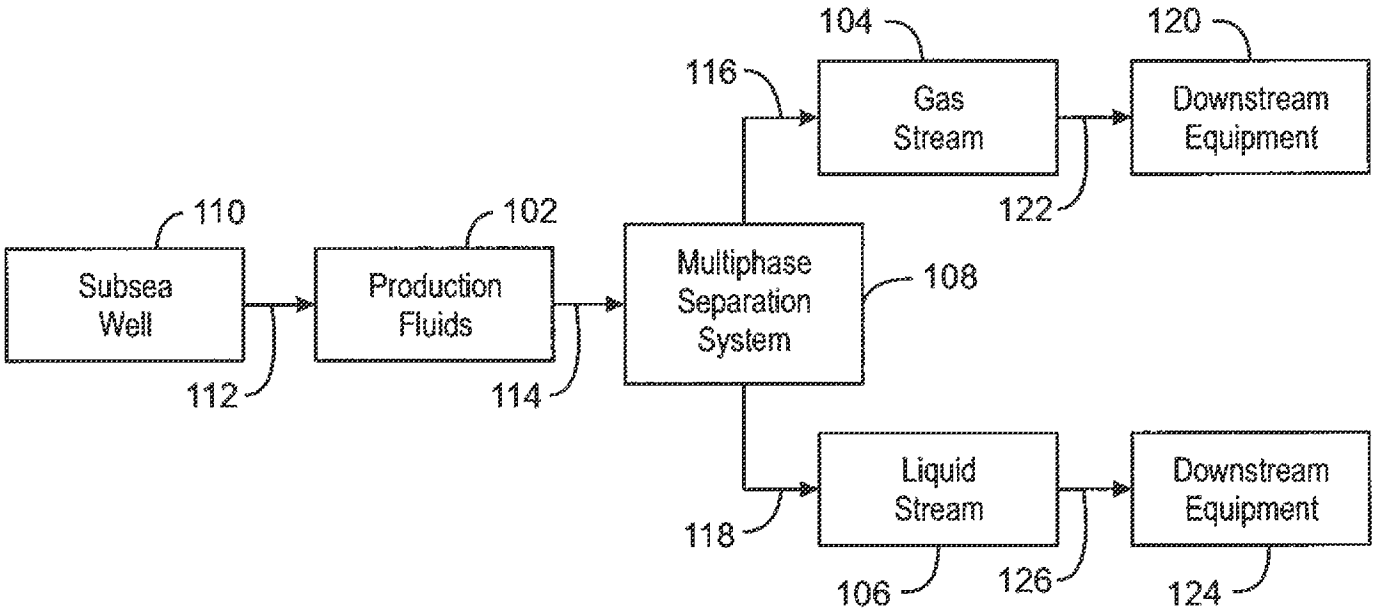
FIG. 1 is a block diagram showing a system for separating production fluids into a gas stream and a liquid stream using a multiphase separation system.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

As discussed above, traditional large diameter separators face technical challenges at depths greater than approximately 1500 meters. Thus, embodiments described herein provide an unconventional separation system that is capable of achieving acceptable gas-liquid separation and damping potential flow fluctuations, while meeting the size and weight restrictions imposed on deepwater processing units. Further, the separation system can be designed to pipe code instead of vessel code, which may provide cost and weight savings. In many cases, for a given pressure class, the required wall thickness for a pipe is less than the required wall thickness for a corresponding vessel.

According to embodiments described herein, a compact, subsea multiphase separation system is used to enhance subsea well production, especially in deepwater and Arctic environments. In various embodiments, the subsea multiphase separation system is a four phase subsea separator that is configured to separate production fluids into a gas phase, an oil phase, an aqueous phase, and a solid phase. In other words, subsea separation may be used to create single phase streams. This may allow for the usage of single phase pumps, which are more efficient and can achieve larger pressure differentials compared to multiphase pumps. In order to pump a single phase stream, one single phase pump may be sufficient. In contrast, in order to pump a multiphase stream, a series of multiphase pumps may be used to achieve the same pressure differential, especially for high boosting applications.

The separation process described herein may be used to achieve bulk removal of aqueous fluids from production fluids. The removal of aqueous fluids is termed water removal herein, although this may be understood to include water with other contaminants, such as salts or other miscible fluids. Such bulk water removal may mitigate flow assurance concerns, by allowing substantially pure oil and/or gas streams to be sent to the surface. These substantially pure streams will form lower amounts of hydrates, such as methane clathrates, thus lowering the risk of plugging or flow restrictions. Further, corrosion concerns can be reduced or eliminated. The sand and water by-product streams can then be disposed topsides to dedicated disposal zones, reservoirs, the seabed, or the like.

Bulk water removal may also result in a decrease in the hydrostatic head acting on the reservoir, thus increasing both the reservoir drive and production. Further, the separation process may be used to reduce flow line infrastructure, reduce the number of topside water treating facilities, reduce power and pumping requirements, and de-bottleneck existing facilities that are challenged with declining production rates due to increased water cuts.

As used herein, the term "slug" refers to a small volume of fluid that is entrained within the production fluids and is often of a higher density than the production fluids, for example, a liquid zone carried along by gas flow in a pipeline. Slugs may affect the flow characteristics of the production fluids. In addition, slugs exiting a pipeline may overload the gas-liquid handling capacity of the subsea, topsides, or onshore processing facility at the pipeline outlet. Thus, according to embodiments described herein, one or more subsea multiphase slug catchers may be used to dampen or remove the slugs from the production fluids before the production fluids enter the export pipelines.

FIG. 1 is a block diagram showing a system 100 for separating production fluids 102 into a gas stream 104 and a liquid stream 106 using a multiphase separation system 108. The production fluids 102 may be hydrocarbon fluids that include a mixture of natural gas, oil, brine, and solid impurities, such as sand. The production fluids 102 may be obtained from a subsea well 110, as indicated by arrow 112. The production fluids 102 may be obtained from the subsea well 110 via any type of subsea production system (not shown) that is configured to produce hydrocarbons from subsea locations.

In an embodiment, the production fluids 102 are flowed into the multiphase separation system 108, as indicated by arrow 114. The multiphase separation system 108 may be any type of vessel that is configured to achieve bulk separation of gas and liquid from the production fluids 102. In addition, the multiphase separation system 108 may remove slugs from the production fluids 102. The multiphase separation system 108 may be implemented within a subsea environment.

Within the multiphase separation system 108, the production fluids 108 may be separated into the gas stream 104 and the liquid stream 106, as indicated by arrows 116 and 118, respectively. The gas stream 104 may include natural gas, while the liquid stream 106 may include water, oil, and other residual impurities, such as sand. Designs for the multiphase separation system 108, as well as the mechanisms by which the multiphase separation system 108 may affect the quality of the separated gas stream 104 and the separated liquid stream 106, are described with respect to FIGS. 2-8.

In some embodiments, the gas stream 104 is flowed to downstream equipment 120, as indicated by arrow 122. The downstream equipment 120 may include, for example, any type of downstream gas processing equipment, such as a gas compressor, gas treatment facility, gas polishing device, or the like, or a gas pipeline. In addition, the liquid stream 106 may be flowed to downstream equipment 124, as indicated by arrow 126. The downstream equipment 124 may include, for example, oil and water pre-treating or coalescence equipment, such as a heating system, chemical injection system, electrostatic coalescer, or the like, a pipe separator or cyclone for oil-water separation, or a liquid export pipeline.

The block diagram of FIG. 1 is not intended to indicate that the system 100 is to include all of the components shown in FIG. 1. Further, any number of additional components may be included within the system 100, depending on the details of the specific implementation. For example, the multiphase separation system 108 can be designed to achieve liquid/liquid separation, thus delivering two substantially pure oil and water streams to the downstream equipment 124. Further, multiphase and single phase desanders may be placed upstream and/or downstream of the multiphase separation system 108.

Figure 2:
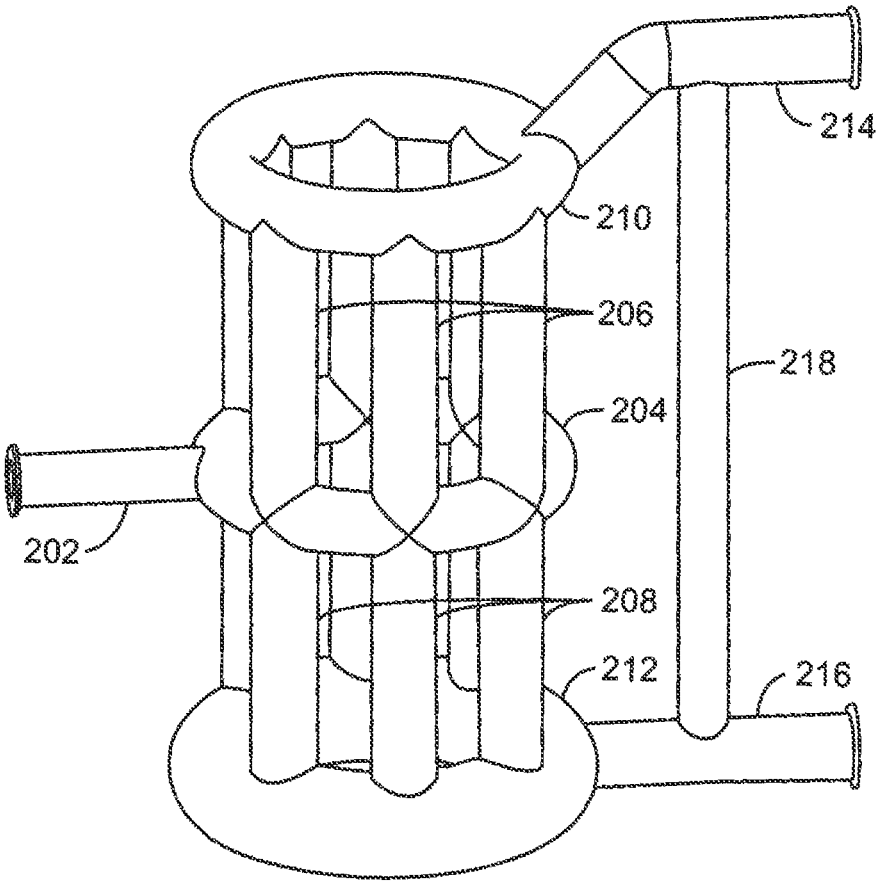
FIG. 2 is a perspective view of a multiphase separation system.

FIG. 2 is a perspective view of a multiphase separation system 200. The multiphase separation system 200 may include an inlet line 202 configured to feed the multiphase fluid into a circular distribution header 204. The multiphase fluid may be any type of fluid that includes both liquid and gaseous components. For example, the multiphase fluid may be production fluids from a subsea well. The circular distribution header 204 may be coupled to a number of upper lines 206 and a number of lower lines 208. The upper lines 206 and the lower lines 208 may be perpendicular to the circular distribution header 204.

Each upper line 206 may feed gases within the multiphase fluid into a circular gas header 210. The circular gas header 210 may be in a second plane that is above and substantially parallel to the circular distribution header 204. In addition, each lower line 208 may feed liquids within the multiphase fluid into a circular liquid header 212. The circular liquid header 212 may be below and substantially parallel to the circular distribution header 204.

A gas outlet line 214 may be coupled to the circular gas header 210 and may be configured to flow the gases out of the multiphase separation system 200. A liquid outlet line 216 may be coupled to the circular liquid header 212 and may be configured to flow the liquids out of the multiphase separation system 200. The gas outlet line 214 and the liquid outlet line 216 may be coupled via a downcomer 218. The downcomer 218 may be configured at a right angle or an oblique angle.

The downcomer 218 may allow entrained liquids within the gases to flow from the gas outlet line 214 to the liquid outlet line 216. In addition, the downcomer 218 may allow entrained gases within the liquids to flow from the liquid outlet line 216 to the gas outlet line 214. However, in some embodiments, the separation of gases and liquids may be sufficient in the upper lines 206 and the lower lines 208 perpendicular to the circular distribution header 204. In this case, the downcomer 218 may be omitted from the multiphase separation system 200.

The schematic of FIG. 2 is not intended to indicate that the subsea multiphase separation system 200 is to include all of the components shown in FIG. 2. Further, any number of additional components may be included within the subsea multiphase separation system 200, depending on the details of the specific implementation. For example, the liquid outlet line 216 may be extended, with or without an optional sealing downcomer, to increase residence time in the liquid phase and achieve oil/water separation. This may allow for the enhancement or the elimination of downstream oil/water separation steps and equipment. In addition, the liquid outlet line 216 may include separate outlet lines for flowing the oil and water out of the multiphase separation system 200.

Figure 3:
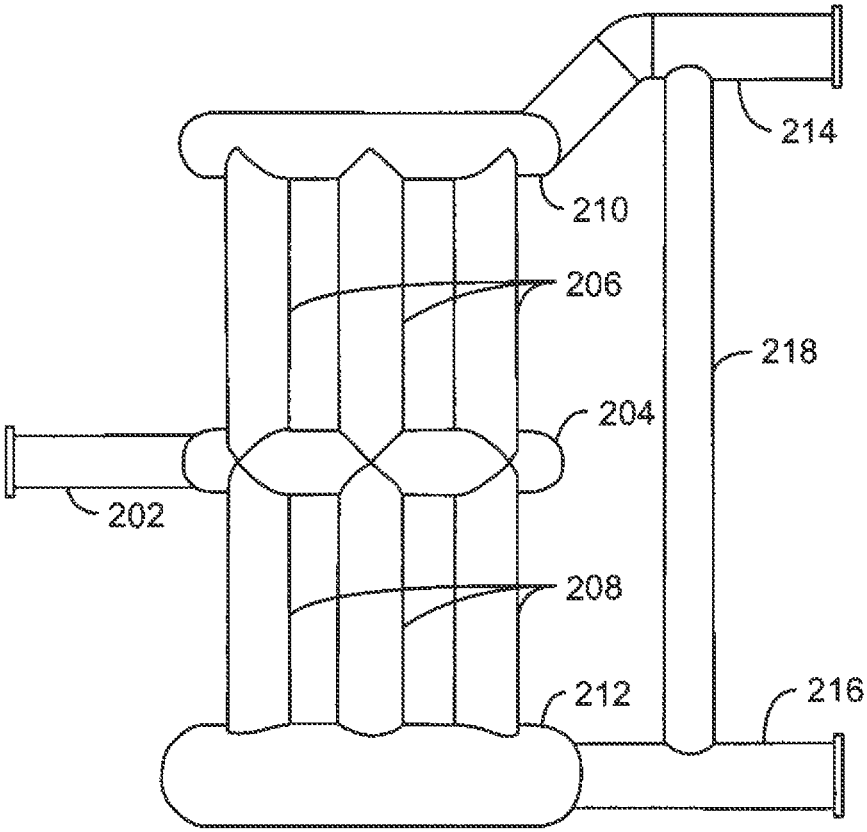
FIG. 3 is a side view of the multiphase separation system of FIG. 2.

FIG. 3 is a side view of the multiphase separation system 200 of FIG. 2. As shown in FIG. 3, the circular distribution header 204 may be in the same plane as the inlet line 202. Thus, the multiphase fluid may flow directly into the circular distribution header 204. Due to the configuration of the circular distribution header 204, the multiphase fluid flow may initially distribute along two flow paths within the circular distribution header 204, resulting in a reduction in velocity of the multiphase fluid as it flows throughout the circular distribution header 204. In some embodiments, such a reduction in velocity of the multiphase fluid dissipates any slugs within the multiphase fluid. In addition, the circular distribution header 204 may act as a stratification section that is configured to perform an initial bulk separation of gases and liquids within the multiphase fluid.

The upper lines 206 may be perpendicular to the circular distribution header 204 and may couple the circular distribution header 204 to the circular gas header 210. The lower lines 208 may be perpendicular to the circular distribution header 204 and may couple the circular distribution header 204 to the circular liquid header 212. The circular gas header 210 and the circular liquid header 212 may be parallel to the circular distribution header 204.

In some embodiments, the circular gas header 210 acts as a droplet separation section configured to remove entrained liquids from the gases within the circular gas header 210. In addition, in some embodiments, the circular liquid header 212 acts as a liquid degassing section configured to remove entrained gases from the liquids within the circular liquid header 212.

Figure 4:
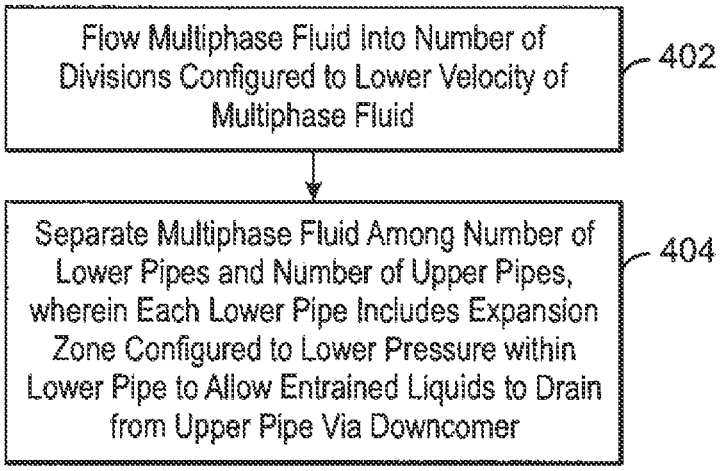
FIG. 4 is a process flow diagram showing a method for separating gases and liquids within a multiphase fluid.
Figure 5:
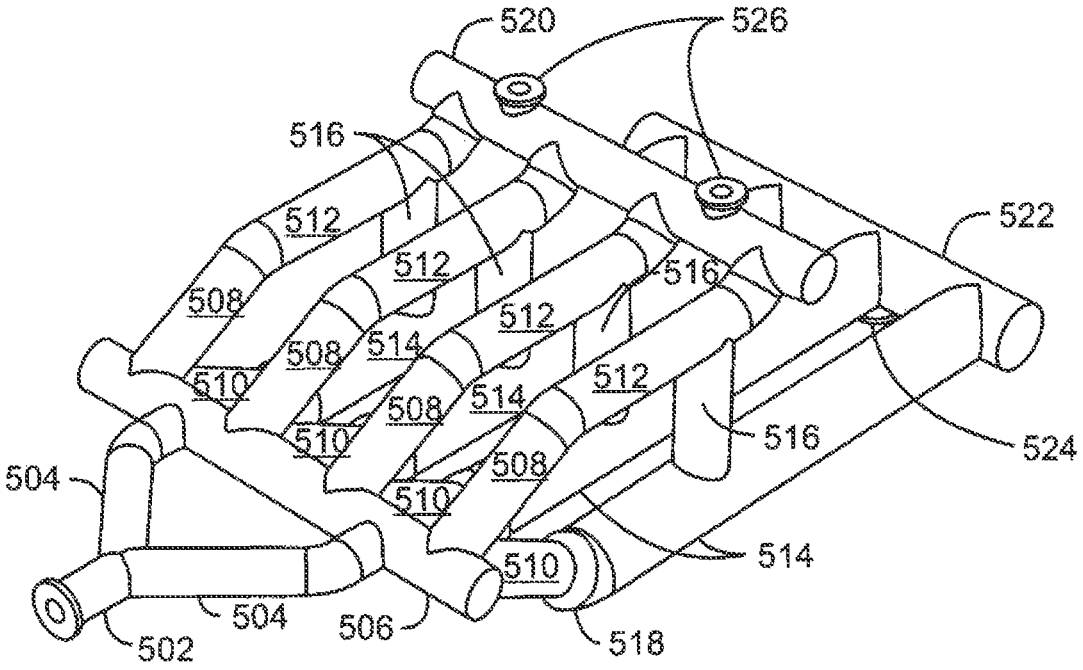
FIG. 5 is a perspective view of another multiphase separation system.
Figure 6:
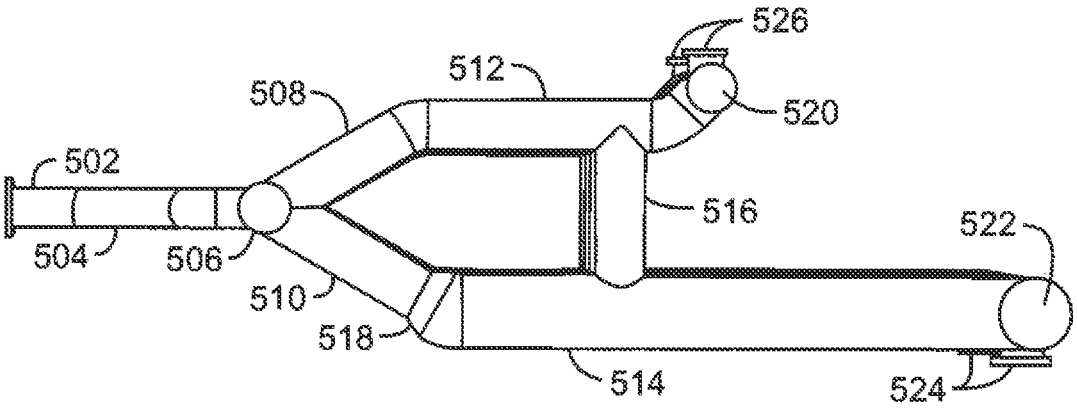
FIG. 6 is a side view of the multiphase separation system of FIG. 5.
Figure 7:
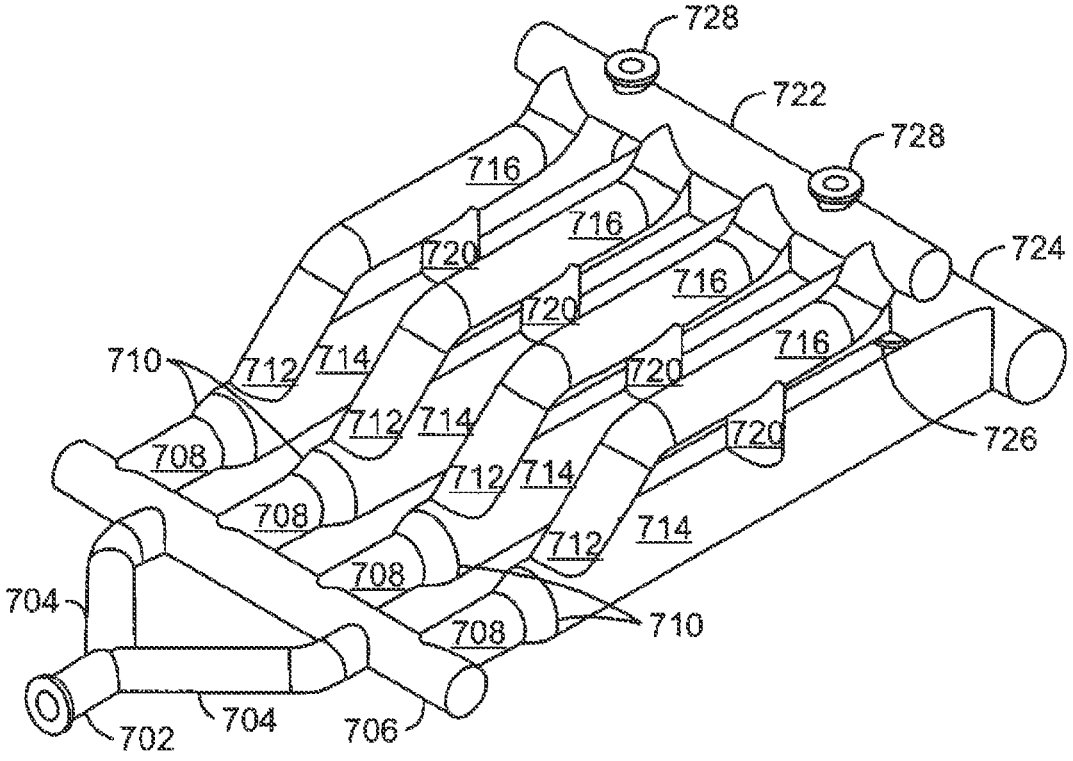
FIG. 7 is a perspective view of another multiphase separation system.
Figure 8:
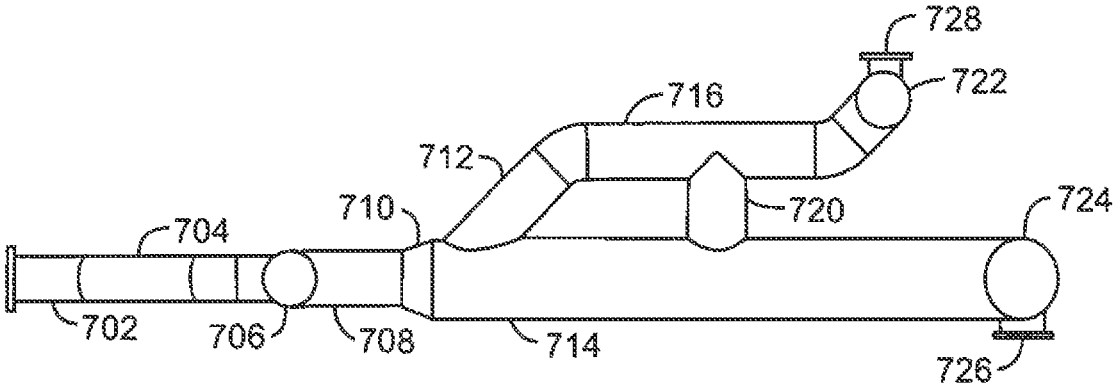
FIG. 8 is a side view of the multiphase separation system of FIG. 7.

FIG. 4 is a process flow diagram showing a method 400 for separating gases and liquids within a multiphase fluid. In some embodiments, the multiphase separation system 500 discussed below with respect to FIGS. 5 and 6 is used to implement the method 400. In other embodiments, the multiphase separation system 700 discussed below with respect to FIGS. 7 and 8 is used to implement the method 400.

The method begins at block 402, at which the multiphase fluid is flowed into a number of divisions configured to lower a velocity of the multiphase fluid. From the divisions, the multiphase fluid may be flowed into a distribution header.

At block 404, the multiphase fluid is separated among a number of lower pipes and a number of upper pipes. Each lower pipe includes an expansion zone configured to lower a pressure within the lower pipe to allow entrained liquids to drain from a corresponding upper pipe via a downcomer.

Liquids flowing through the lower pipes may be collected within a liquid header. The liquids may then be flowed out of the multiphase separation system via a liquid outlet line. Gases flowing through the upper pipes may be collected within a gas header. The gases may then be flowed out of the multiphase separation system via a gas outlet line.

The process flow diagram of FIG. 4 is not intended to indicate that the steps of the method 400 are to be executed in any particular order, or that all of the steps of the method 400 are to be included in every cases. Further, any number of additional steps not shown in FIG. 4 may be included within the method 400, depending on the details of the specific implementation. For example, gases may be flowed from the multiphase separation system to downstream liquid processing equipment or a gas export line, and liquids may be flowed from the multiphase separation system to downstream gas processing equipment or a liquid export line.

In various embodiments, the multiphase fluid is flowed into a distribution header configured to split the multiphase fluid among a number of pipes in a same plane as the distribution header. The multiphase fluid may be separated into gases and liquids within an expansion zone of each pipe. The gases within each pipe may be flowed into a corresponding upper pipe in a second plane disposed above a plane of the distribution header, and the liquids within each pipe may be flowed into a corresponding lower pipe in the plane of the distribution header. Entrained liquids within each upper pipe may then be drained to a corresponding lower pipe via a downcomer. In addition, entrained gases within each lower pipe may be flowed to a corresponding upper pipe via the downcomer.

In other embodiments, the multiphase fluid is separated into gases and liquids within a distribution header. The gases may be flowed into a number of upper pipes in a first plane disposed above the distribution header, and the liquids may be flowed into a number of lower pipes in a second plane disposed below the distribution header. The gases may be flowed out of the multiphase separation system via a gas outlet line, and the liquids may be flowed out of the multiphase separation system via a liquid outlet line. In addition, entrained liquids within the upper pipes may be drained to corresponding lower pipes via downcomers.

FIG. 5 is a perspective view of another multiphase separation system 500. The multiphase separation system 500 may include an inlet line 502 that is configured to allow a multiphase fluid to flow into the multiphase separation system 500. The inlet line 502 may include a number of divisions 504 that are configured to lower the velocity of the multiphase fluid and feed the multiphase fluid into a distribution header 506.

The distribution header 506 may be configured to split the multiphase fluid among a number of upper fingers 508 and a number of lower fingers 510. Each upper finger 508 is angled upward to feed into a corresponding upper pipe 512 in a first plane disposed above and substantially parallel to the distribution header 506. Each lower finger 510 is angled downward to feed into a corresponding lower pipe 514 in a second plane disposed below and substantially parallel to the distribution header 506. In addition, each upper pipe 512 may be coupled to a corresponding lower pipe 514 via a downcomer 516. The downcomer 516 may be configured perpendicular to the upper pipes 512 and lower pipes 514, or may be at an oblique angle.

Each lower pipe 514 may include an expansion zone 518 that is configured to lower a velocity and a pressure of liquids within the lower pipe 514. This may allow entrained gases within the liquids to rise to the corresponding upper pipe 512 via the downcomer 516.

Each upper pipe 512 may feed into a common gas header 520. The gas header 520 may be configured to lower a velocity of gases within the upper pipe 512 to allow entrained liquids, such as droplets, within the gases to coalesce and drop to the corresponding lower pipe 514 via the downcomer 516.

The multiphase separation system 500 may also include a liquid header 522 for collecting the liquids and flowing the liquids out of the multiphase separation system 500 via liquid outlet lines 524. In addition, the gas header 520 may include gas outlet lines 526 for flowing the gases out of the multiphase separation system 500.

The schematic of FIG. 5 is not intended to indicate that the subsea multiphase separation system 500 is to include all of the components shown in FIG. 5. Further, any number of additional components may be included within the subsea multiphase separation system 500, depending on the details of the specific implementation. For example, the lower pipe 514 may be extended, with or without an optional sealing downcomer, to increase residence time in the liquid phase and achieve oil/water separation. This may allow for the enhancement or the elimination of downstream oil/water separation steps and equipment. Separate oil and water outlets can be included in the liquid header 522 for flowing the oil and water out of the multiphase separation system 500.

FIG. 6 is a side view of the multiphase separation system 500 of FIG. 5. As shown in FIG. 6, the divisions 504 may be in the same plane as the inlet line 502. Thus, the multiphase fluid may be flowed directly into the divisions 504 from the inlet line 502. However, because the multiphase fluid is split among the divisions 504, the velocity of the multiphase fluid is reduced. In some embodiments, the reduction in velocity of the multiphase fluid dissipates any slugs within the multiphase fluid.

The distribution header 506 may also be in the same plane as the inlet line 502. Thus, the multiphase fluid may be flowed directly into the distribution header 506 from the divisions 504. Within the distribution header 506, the multiphase fluid may be split among the upper fingers 508 and the lower fingers 510. This may further reduce the velocity of the multiphase fluid.

In some embodiments, the distribution header 506 is a stratification section that is configured to perform an initial bulk separation of gases and liquids within the multiphase fluid. Thus, gases may be flowed into the upper fingers 508, and liquids may be flowed into the lower fingers 510. The gases may be flowed from the upper fingers 508 to corresponding upper pipes 512, and the liquids may be flowed from the lower fingers 510 to corresponding lower pipes 514. In some embodiments, the upper pipes 512 are parallel to the lower pipes 514.

FIG. 7 is a perspective view of another multiphase separation system 700. The multiphase separation system 700 may include an inlet line 702 configured to allow a multiphase fluid to flow into the multiphase separation system 700. The inlet line 702 may include a number of divisions 704 configured to lower a velocity of the multiphase fluid and feed the multiphase fluid into a distribution header 706.

The distribution header 706 is configured to split the multiphase fluid among a number of pipes 708 in a same plane as the distribution header. Each pipe 708 may include an expansion zone 710 configured to lower the velocity and the pressure of the multiphase fluid. The multiphase fluid is split between each upper finger 712 and a corresponding lower pipe 714.

Each upper finger 712 may feed into a corresponding upper pipe 716 in a second plane disposed above and substantially parallel to the plane of the distribution header 706. Each lower pipe 714 may be in the same plane as the distribution header 706. In addition, each upper pipe 716 may be coupled to a corresponding lower pipe 714 via a downcomer 720. The downcomer 720 may be configured at a right angle (as shown) or an oblique angle.

Each lower pipe 714 can be configured to allow entrained gases within liquids to rise to the corresponding upper pipe 716 via the downcomer 720. Each upper pipe 716 may feed into a common gas header 722. The gas header 722 may be configured to lower a velocity of gases to allow entrained liquid droplets to coalesce and drop to any of the lower pipes 714 via any of the downcomers 720.

The multiphase separation system 700 may include a liquid header 724 for collecting the liquids from the lower pipes 714 and flowing the liquids out of the multiphase separation system 700 via liquid outlet lines 726. In addition, the gas header 722 may include gas outlet lines 728 for flowing the gases out of the multiphase separation system 700.

The schematic of FIG. 7 is not intended to indicate that the subsea multiphase separation system 700 is to include all of the components shown in FIG. 7. Further, any number of additional components may be included within the subsea multiphase separation system 700, depending on the details of the specific implementation. For example, the lower pipe 714 may be extended, with or without an optional sealing downcomer, to increase residence time in the liquid phase and achieve oil/water separation. This may allow for the enhancement or the elimination of downstream oil/water separation steps and equipment. Separate oil and water outlets can be included in the liquid header 724 for flowing the oil and water out of the multiphase separation system 700.

FIG. 8 is a side view of the multiphase separation system 700 of FIG. 7. As shown in FIG. 8, the divisions 704 may be in the same plane as the inlet line 702. Thus, the multiphase fluid may be flowed directly into the divisions 704 from the inlet line 702. However, because the multiphase fluid is split among the divisions 704, the velocity of the multiphase fluid is reduced. In some embodiments, such a reduction in velocity of the multiphase fluid dissipates any slugs within the multiphase fluid.

The distribution header 706 may also be in the same plane as the inlet line 702. Thus, the multiphase fluid may be flowed directly into the distribution header 706 from the divisions 704. Within the distribution header 706, the multiphase fluid may be split among the pipes 708. Within the pipes 708, the multiphase fluid may be flowed through the expansion zone 710, resulting in a reduction of the pressure and velocity of the multiphase fluid.

The multiphase fluid may then be split between each of the upper fingers 712 and the corresponding lower pipe 714. This may further reduce the velocity of the multiphase fluid. In some embodiments, the distribution header 706 acts as stratification section that is configured to perform an initial bulk separation of gases and liquids within the multiphase fluid. Thus, gases may be flowed into the upper fingers 712, and liquids may remain in the lower pipes 714. In addition, the gases may be flowed from the upper fingers 712 to corresponding upper pipes 716. In some embodiments, the upper pipes 716 are parallel to the lower pipes 714.

Embodiments

Embodiments of the invention may include any combinations of the methods and systems shown in the following numbered paragraphs. This is not to be considered a complete listing of all possible embodiments, as any number of variations can be envisioned from the description above.

1. A multiphase separation system, including:
   an inlet line configured to allow a multiphase fluid to flow into the multiphase separation system, the inlet line including a number of divisions configured to lower a velocity of the multiphase fluid and feed the multiphase fluid into a distribution header;
   the distribution header configured to split the multiphase fluid among a number of lower pipes, wherein each of the number of lower pipes includes an expansion zone upstream of a corresponding downcomer, and wherein the expansion zone is configured to lower a pressure within the number of lower pipes to allow entrained liquids to drain from a number of upper pipes via the corresponding downcomer.
2. The multiphase separation system of paragraph 1, including a liquid header for collecting the liquids from the number of lower pipes and flowing the liquids out of the multiphase separation system via a liquid outlet line.

3. The multiphase separation system of any of paragraphs 1 or 2, wherein each of the number of upper pipes feeds into a common gas header, and wherein the common gas header includes a gas outlet line for flowing the gases from the number of upper pipes out of the multiphase separation system.
4. The multiphase separation system of any of paragraphs 1, 2, or 3, wherein entrained gases within any of the number of lower pipes rise to any of the number of upper pipes via the corresponding downcomer.
5. The multiphase separation system of any of paragraphs 1-4, including a stratification section upstream of each expansion zone that is configured to separate gases from liquids within the multiphase fluid.
6. The multiphase separation system of any of paragraphs 1-5, wherein the multiphase separation system is implemented within a subsea environment.
7. The multiphase separation system of any of paragraphs 1-6, wherein the multiphase separation system includes a slug catcher.
8. The multiphase separation system of any of paragraphs 1-7, wherein a desander is located upstream of the inlet line.
9. The multiphase separation system of any of paragraphs 1-8, wherein a desander is located downstream of a liquid outlet line.
10. The multiphase separation system of any of paragraphs 1-9, including;
an oil/water separation section that is coupled to each of a number of lower pipes and is configured to separate the liquids into oil and water;
an oil outlet line that is configured to flow the oil out of the multiphase separation system; and
a water outlet line that is configured to flow the water out of the multiphase separation system.
11. The multiphase separation system of paragraph 10, wherein the oil/water separation section is coupled to each of the number of lower pipes via a sealing downcomer.
12. The multiphase separation system of any of paragraphs 1-10, wherein the distribution header is configured to split the multiphase fluid among a number of pipes in a same plane as the distribution header, and wherein:
each pipe includes an expansion zone upstream of an upper and a lower finger that is configured to lower a pressure of the multiphase fluid prior to separating the multiphase fluid among the upper finger and the lower finger;
each upper finger feeds into a corresponding upper pipe in a second plane disposed above a plane of the distribution header;
each lower finger feeds into a corresponding lower pipe in the plane of the distribution header;
each upper pipe is coupled to a corresponding lower pipe by a downcomer;
each lower pipe is configured to allow entrained gases to rise to the corresponding upper pipe via the downcomer; and
each upper pipe is configured to allow entrained liquids to drain to the corresponding lower pipe via the downcomer.
13. The multiphase separation system of paragraph 12, wherein each upper finger is raised at an acute angle relative to the distribution header, and wherein each lower finger is in the plane of the distribution header.
14. The multiphase separation system of any of paragraphs 12 or 13, wherein each upper finger includes a droplet separation section configured to remove the entrained liquids from gases.
15. The multiphase separation system of any of paragraphs 12, 13, or 14, wherein each lower finger includes a liquid degassing section configured to remove entrained gases from the liquids.
16. The multiphase separation system of any of paragraphs 1-10 or 12, wherein the distribution header is configured to split the multiphase fluid among a number of upper fingers and a number of lower fingers, and wherein:
each upper finger feeds into a corresponding upper pipe in a first plane disposed above the distribution header;
each lower finger feeds into a corresponding lower pipe in a second plane disposed below the distribution header;
each upper pipe is coupled to a corresponding lower pipe by a downcomer;
each lower pipe includes an expansion zone configured to lower a pressure within the number of lower pipes to allow entrained liquids to drain from the number of upper pipes via a corresponding downcomer.
17. The multiphase separation system of paragraph 16, wherein each upper finger is raised at an acute angle relative to the distribution header, and wherein each lower finger is lowered at an acute angle relative to the distribution header.
18. The multiphase separation system of any of paragraphs 16 or 17, wherein each upper finger includes a droplet separation section configured to remove the entrained liquids from gases.
19. The multiphase separation system of any of paragraphs 16, 17, or 18, wherein each lower finger includes a liquid degassing section configured to remove entrained gases from liquids.
20. The multiphase separation system of any of paragraphs 1-10, 12, or 16, wherein the multiphase fluid includes slugs including liquids entrained within gases.
21. A method for separation of liquids and gases within a multiphase fluid, including:
flowing a multiphase fluid into a number of divisions within a multiphase separation system, wherein the number of divisions are configured to lower a velocity of the multiphase fluid; and
separating the multiphase fluid among a number of lower pipes and a number of upper pipes, wherein each of the number of lower pipes includes an expansion zone upstream of a downcomer that is configured to lower a pressure within the lower pipe to allow entrained liquids to drain from a corresponding upper pipe via the downcomer.
22. The method of paragraph 21, including:
flowing gases from the multiphase separation system to downstream gas processing equipment or a gas export line; and
flowing the liquids from the multiphase separation system to downstream liquid processing equipment or a liquid export line.
23. The method of any of paragraphs 21 or 22, including:
separating the liquids into oil and water;
flowing the oil out of the multiphase separation system via an oil outlet line; and
flowing the water out of the multiphase separation system via a water outlet line.
24. The method of any of paragraphs 21, 22, or 23, including:
collecting the liquids within a liquid header; and
flowing the liquids out of the multiphase separation system via a liquid outlet line.
25. The method of any of paragraphs 21-24, including:
collecting the gases within a gas header; and flowing the gases out of the multiphase separation system via a gas outlet line.

26. The method of any of paragraphs 21-25, including:

flowing the multiphase fluid into a distribution header configured to split the multiphase fluid among a number of pipes in a same plane as the distribution header;

separating the multiphase fluid into gases and liquids within an expansion zone of each of the number of pipes;

flowing the gases within each of the number of pipes into a corresponding upper pipe in a second plane disposed above a plane of the distribution header; and flowing the liquids within each of the number of pipes into a corresponding lower pipe in the plane of the distribution header;

wherein entrained liquids within each upper pipe are drained to a corresponding lower pipe via a downcomer.

27. The method of paragraph 26, including flowing entrained gases within each lower pipe to a corresponding upper pipe via the downcomer.

28. The method of any of paragraphs 26 or 27, including lowering a velocity and a pressure of the multiphase fluid by splitting the multiphase fluid among the number of pipes in the same plane as the distribution header.

29. The method of any of paragraphs 21-26, including:

separating the multiphase fluid into gases and liquids within a distribution header;

flowing the gases into a number of upper pipes in a first plane disposed above the distribution header;

flowing the liquids into a number of lower pipes in a second plane disposed below the distribution header, flowing the gases out of the multiphase separation system via a gas outlet line; and flowing the liquids out of the multiphase separation system via a liquid outlet line;

wherein entrained liquids within any of the number of upper pipes are drained to a corresponding lower pipe via a downcomer.

30. The method of paragraph 29, including flowing the gases into the number of upper pipes via a number of upper fingers.

31. The method of any of paragraphs 29 or 30, including lowering a velocity and a pressure of the gases within the distribution header.

32. The method of any of paragraphs 29, 30, or 31, including flowing the liquids into the number of lower pipes via a number of lower fingers.

33. The method of paragraph 32, including separating entrained gases from the liquids within a liquid degassing section of each of the number of lower fingers.

34. The method of any of paragraphs 29-32, including lowering a velocity and a pressure of the liquids within the distribution header.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A multiphase separation system, comprising:

an inlet line configured to allow a multiphase fluid to flow into the multiphase separation system, the inlet line comprising a plurality of divisions configured to lower a velocity of the multiphase fluid and feed the multiphase fluid into a distribution header;

the distribution header configured to split the multiphase fluid among a plurality of pipes, wherein each of the plurality of pipes includes an expansion zone forming part of each of the plurality of pipes and disposed upstream of a corresponding downcomer, wherein the plurality of pipes are in the same plane as the distribution header, and wherein the expansion zone is configured to lower a pressure within the plurality of pipes to allow entrained liquids to drain from a plurality of upper pipes via the corresponding downcomer;

wherein each expansion zone is upstream of an upper and a lower finger and is configured to lower the pressure of the multiphase fluid prior to separating the multiphase fluid among the upper and the lower finger;

each upper finger feeds into one of the corresponding upper pipes, which are disposed above a plane of the distribution header;

each lower finger feeds into a corresponding lower pipe;

each upper pipe is coupled to a corresponding lower pipe by the corresponding downcomer; and each upper pipe is configured to allow entrained liquids to drain to the corresponding lower pipe via the corresponding downcomer.

2. The multiphase separation system of claim 1, comprising a liquid header for collecting the liquids from the plurality of lower pipes and flowing the liquids out of the multiphase separation system via a liquid outlet line.

3. The multiphase separation system of claim 1, wherein each of the plurality of upper pipes feeds into a common gas header, and wherein the common gas header comprises a gas outlet line for flowing the gases from the plurality of upper pipes out of the multiphase separation system.

4. The multiphase separation system of claim 1, wherein entrained gases within any of the plurality of lower pipes rise to any of the plurality of upper pipes via the corresponding downcomer.

5. The multiphase separation system of claim 1, comprising a stratification section upstream of each expansion zone that is configured to separate gases from liquids within the multiphase fluid.

6. The multiphase separation system of claim 1, wherein the multiphase separation system is implemented within a subsea environment.

7. The multiphase separation system of claim 1, wherein the multiphase separation system comprises a slug catcher.

8. The multiphase separation system of claim 1, wherein a desander is located upstream of the inlet line.

9. The multiphase separation system of claim 1, wherein a desander is located downstream of a liquid outlet line.

10. The multiphase separation system of claim 1, comprising;

an oil/water separation section that is coupled to each of the plurality of lower pipes and is configured to separate the liquids into oil and water;

an oil outlet line that is configured to flow the oil out of the multiphase separation system; and a water outlet line that is configured to flow the water out of the multiphase separation system.

11. The multiphase separation system of claim 10, wherein the oil/water separation section is coupled to each of the plurality of lower pipes via a sealing downcomer.

12. The multiphase separation system of claim 1, wherein each upper finger is raised at an acute angle relative to the distribution header.

13. The multiphase separation system of claim 1, wherein each upper finger comprises a droplet separation section configured to remove the entrained liquids from gases.

14. The multiphase separation system of claim 1, wherein each lower finger comprises a liquid degassing section configured to remove entrained gases from the liquids.

15. The multiphase separation system of claim 1, wherein the multiphase fluid comprises slugs comprising liquids entrained within gases.

16. A multiphase separation system, comprising:

an inlet line configured to allow a multiphase fluid to flow into the multiphase separation system, the inlet line comprising a plurality of divisions configured to lower a velocity of the multiphase fluid and feed the multiphase fluid into a distribution header;

the distribution header configured to split the multiphase fluid among a plurality of upper fingers and a plurality of lower pipes, wherein each of the plurality of lower pipes includes an expansion zone forming part of each of the plurality of lower pipes and disposed upstream of a corresponding downcomer, wherein the plurality of lower pipes are in the same plane as the distribution header, and wherein the expansion zone is configured to lower a pressure within the plurality of lower pipes to allow entrained liquids to drain from a plurality of upper pipes via the corresponding downcomer;

wherein each upper finger feeds into a corresponding upper pipe in a first plane disposed above the distribution header; and each upper pipe is coupled to a corresponding lower pipe by the corresponding downcomer.

17. The multiphase separation system of claim 16, wherein each upper finger is raised at an acute angle relative to the distribution header.

18. The multiphase separation system of claim 16, wherein each upper finger comprises a droplet separation section configured to remove the entrained liquids from gases.

19. The multiphase separation system of claim 16, wherein each lower finger comprises a liquid degassing section configured to remove entrained gases from liquids.

20. A method for separation of liquids and gases within a multiphase fluid, comprising:

flowing a multiphase fluid through a distribution header into a plurality of divisions within a multiphase separation system, wherein the plurality of divisions are configured to lower a velocity of the multiphase fluid; and separating the multiphase fluid among a plurality of lower pipes and a plurality of upper pipes, wherein the plurality of lower pipes are in the same plane as the distribution header and the plurality of upper pipes are disposed in a second plane disposed above the plane of the distribution header, and wherein each of the plurality of lower pipes includes an expansion zone forming part of each of the plurality of lower pipes and disposed upstream of a corresponding downcomer that is configured to lower a pressure within the plurality of lower pipes to allow entrained liquids to drain from a corresponding upper pipe via the corresponding downcomer;

separating the multiphase fluid into gases and liquids within the expansion zone of each of the plurality of lower pipes;

flowing the gases within each of the plurality of lower pipes into a corresponding one of the plurality of upper pipes; and flowing the liquids within each of the plurality of upper pipes into a corresponding lower pipe, wherein entrained liquids within each upper pipe are drained to a corresponding lower pipe via the corresponding downcomer.

21. The method of claim 20, comprising:

flowing gases from the multiphase separation system to downstream gas processing equipment or a gas export line; and flowing the liquids from the multiphase separation system to downstream liquid processing equipment or a liquid export line.

22. The method of claim 20, comprising:

separating the liquids into oil and water;

flowing the oil out of the multiphase separation system via an oil outlet line; and flowing the water out of the multiphase separation system via a water outlet line.

23. The method of claim 20, comprising:

collecting the liquids within a liquid header; and flowing the liquids out of the multiphase separation system via a liquid outlet line.

24. The method of claim 20, comprising:

collecting the gases within a gas header; and flowing the gases out of the multiphase separation system via a gas outlet line.

25. The method of claim 20, comprising flowing entrained gases within each lower pipe to a corresponding upper pipe via the corresponding downcomer.

26. The method of claim 20, comprising lowering a velocity and a pressure of the multiphase fluid by splitting the multiphase fluid among the plurality of pipes in the same plane as the distribution header.

27. A method for separation of liquids and gases within a multiphase fluid, comprising:

flowing a multiphase fluid through a distribution header into a plurality of divisions within a multiphase separation system, wherein the plurality of divisions are configured to lower a velocity of the multiphase fluid;

separating the multiphase fluid among a plurality of lower pipes and a plurality of upper pipes, wherein the plurality of lower pipes are in the same plane as the distribution header, and wherein each of the plurality of lower pipes includes an expansion zone forming part of each of the plurality of lower pipes and disposed upstream of a corresponding downcomer that is configured to lower a pressure within the plurality of lower pipes to allow entrained liquids to drain from a corresponding upper pipe via the corresponding downcomer;

separating the multiphase fluid into gases and liquids within the distribution header;

flowing the gases into the plurality of upper pipes in a first plane disposed above the distribution header;

flowing the liquids into the plurality of lower pipes;

flowing the gases out of the multiphase separation system via a gas outlet line; and flowing the liquids out of the multiphase separation system via a liquid outlet line;

wherein entrained liquids within any of the plurality of upper pipes are drained to a corresponding lower pipe via a corresponding downcomer.

28. The method of claim 27, comprising flowing the gases into the plurality of upper pipes via a plurality of upper fingers.

29. The method of claim 27, comprising lowering a velocity and a pressure of the gases within the distribution header.

30. The method of claim 27, comprising flowing the liquids into the plurality of lower pipes via a plurality of lower fingers.

31. The method of claim 30, comprising separating entrained gases from the liquids within a liquid degassing section of each of the plurality of lower fingers.

32. The method of claim 27, comprising lowering a velocity and a pressure of the liquids within the distribution header.

* * * * *